US008505638B2

(12) United States Patent
Ezell et al.

(10) Patent No.: US 8,505,638 B2
(45) Date of Patent: Aug. 13, 2013

(54) RESTRICTED AXIAL MOVEMENT LOCKING MECHANISM

(75) Inventors: Michael Dale Ezell, Carrollton, TX (US); Gary Dale Ellis, Plano, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 285 days.

(21) Appl. No.: 13/049,153

(22) Filed: Mar. 16, 2011

(65) Prior Publication Data

US 2012/0234560 A1 Sep. 20, 2012

(51) Int. Cl.
*E21B 17/046* (2006.01)
*E21B 23/04* (2006.01)

(52) U.S. Cl.
CPC ..... *E21B 17/046* (2013.01); *E21B 23/04* (2013.01)
USPC ..... 166/382; 166/383; 166/242.7

(58) Field of Classification Search
USPC ..... 166/382, 383, 242.7; 285/302, 920, 285/922
See application file for complete search history.

(56) References Cited

U.S. PATENT DOCUMENTS

| | | | |
|---|---|---|---|
| 4,307,902 | A | 12/1981 | Schnatzmeyer |
| 4,531,766 | A | 7/1985 | Crase |
| 7,717,472 | B2 | 5/2010 | Johnson |
| 7,779,935 | B2 | 8/2010 | Jagert et al. |
| 2010/0236835 | A1 | 9/2010 | Marshall et al. |

OTHER PUBLICATIONS

Foreign communication from a related counterpart application—International Search Report and Written Opinion, PCT/US2012/028330, Aug. 1, 2012, 6 pages.

*Primary Examiner* — Cathleen Hutchins
(74) *Attorney, Agent, or Firm* — Conley Rose, P.C.; Scott Wendorf

(57) ABSTRACT

A tubular locking system comprises a first wellbore tubular, an internal locking feature disposed on an inner surface of the first wellbore tubular, a second wellbore tubular, where at least a portion of the second wellbore tubular is disposed within the first wellbore tubular, a compression sleeve coupled to the second wellbore tubular, a collet coupled to the second wellbore tubular below the compression sleeve, and a shifting sleeve disposed within the collet.

29 Claims, 8 Drawing Sheets

RESTRICTED AXIAL MOVEMENT LOCKING MECHANISM

CROSS-REFERENCE TO RELATED APPLICATIONS

None.

STATEMENT REGARDING FEDERALLY SPONSORED RESEARCH OR DEVELOPMENT

Not applicable.

REFERENCE TO A MICROFICHE APPENDIX

Not applicable.

BACKGROUND

During drilling and upon completion and production of an oil and/or gas wellbore, a workover and/or completion tubular string can be installed in the wellbore to allow for production of oil and/or gas from the well. Some tubular strings can include multiple wellbore tubulars arranged in an approximately concentric or co-axial alignment with an inner wellbore tubular disposed within the center of an outer wellbore tubular. Such orientations can allow for multiple production paths between a zone of interest in the wellbore and the surface. In some instances this arrangement may allow for production of oil and/or gas from multiple zones of interest in a single wellbore without the need to comingle the fluids during transport to the surface. The arrangement of multiple wellbore tubulars in co-axial alignment may be used in a variety of processes.

The co-axial arrangement of wellbore tubulars may have several drawbacks. For example, relative movement between two or more wellbore tubulars may cause friction and wear on the tubular walls. In some instances, one or more tools associated with the wellbore tubulars may experience wear due to contact during the relative movement, which may result in expensive workovers to repair and/or replace the components. As another example, seals may be used to isolate various flow paths within the tubular strings. The seals are generally designed to form a static engagement between two surfaces, and the relative movement of the sealing surfaces may result in damage to the seal, which may lead to leakage and/or eventual failure of the seal.

SUMMARY

In an embodiment, a tubular locking system comprises a first wellbore tubular, and an internal locking feature disposed on an inner surface of the first wellbore tubular. The tubular locking system also comprises a second wellbore tubular, where at least a portion of the second wellbore tubular is disposed within the first wellbore tubular, a compression sleeve coupled to the second wellbore tubular, a collet coupled to the second wellbore tubular below the compression sleeve, and a shifting sleeve disposed within the collet. The first wellbore tubular may comprise drill pipe, casing, a liner, jointed tubing, coiled tubing, or a collar on a downhole tool. The second wellbore tubular may comprise drill pipe, a liner, jointed tubing, or coiled tubing. The collet may comprise a collet mandrel comprising a plurality of longitudinal slots; and a collet protrusion disposed on the outside surface of the collet mandrel. The tubular locking system may also include a longitudinal flow passage extending from the second wellbore tubular through the compression sleeve, the collet, and the shifting sleeve. The tubular locking system may also include a guide coupled to the lower end of the second wellbore tubular below the collet. The guide may comprise a guide shoulder that restricts the downward movement of the shifting sleeve within the collet. The locking feature may comprise a collet indicator comprising one or more flat surfaces. The one or more flat surfaces may be disposed at obtuse angles as measured in an longitudinal direction between the one or more flat surface as and an inner surface of the first wellbore tubular. The tubular locking system may also include a collet shoulder disposed on an inner surface of the collet, where the collet shoulder is configured to restrict the upper movement of the shifting sleeve within the collet. The first wellbore tubular may have a relative axial motion with respect to the second wellbore tubular of less than 2 inches when the shifting sleeve is radially aligned with the collet protrusion.

In an embodiment, a tubular locking system comprises a first wellbore tubular, and an internal locking feature disposed on an inner surface of the first wellbore tubular. The tubular locking system also comprises a second wellbore tubular, where at least a portion of the second wellbore tubular is disposed within the first wellbore tubular, a compression sleeve slidingly engaged with the second wellbore tubular, a collet coupled to the second wellbore tubular below the compression sleeve, and a shifting sleeve disposed within the collet. The tubular locking system may also includes a piston that comprises a hydraulic chamber formed by an surface of the compression sleeve and a portion of the second wellbore tubular, and a port configured to provide fluid communication between a flow passage through the second wellbore tubular and the hydraulic chamber. The tubular locking system may also include a body locking mechanism. The body locking mechanism may comprise ratchet teeth disposed on an inner surface of the compression sleeve that engage ratchet teeth disposed on an outer surface of the collet. The tubular locking system may also include a sealing device disposed within the second wellbore tubular above the collet. The tubular locking system may also include a downhole sealing tool disposed within the second wellbore tubular that is configured to form a seal within the second wellbore tubular above the collet.

In an embodiment, a method comprises disposing a first wellbore tubular in a wellbore, where the first wellbore tubular comprises a locking feature disposed on an inner surface of the first wellbore tubular, providing a second wellbore tubular within the first wellbore tubular, wherein the second wellbore tubular comprises an axial locking mechanism coupled thereto. The axial locking mechanism comprises a compression sleeve coupled to the second wellbore tubular, a collet coupled to the second wellbore tubular below the compression sleeve, wherein the collet comprises a collet mandrel comprising a plurality of longitudinal slots; and a collet protrusion disposed on the outside surface of the collet mandrel, and a shifting sleeve disposed within the collet. The method also comprises positioning the locking feature between the collet protrusion and the compression sleeve, and shifting the shifting sleeve into an activated position. The shifting sleeve may be shifted using a downhole tool to engage the shifting sleeve and shift the shifting sleeve within the second tubular. The shifting sleeve may also be shifted using slick line, wireline, or coiled tubing. The shifting sleeve may further be shifted moving the shifting sleeve to engage an inner collet shoulder disposed within the collet mandrel. The shifting sleeve may also be shifted by radially aligning the shifting sleeve with the collet protrusion. The compression sleeve may be slidingly coupled to the second wellbore tubular, and the axial locking mechanism may also include a piston that comprises a hydraulic chamber formed by an surface of the compression sleeve and a portion of the second tubular, and a port configured to provide fluid communication between a flow passage through the second wellbore tubular and the hydraulic chamber. The method may also include forming at least a partial seal within the second wellbore tubular above the collet; pressurizing a longitudinal flow passage within the second wellbore tubular; and activating the compression sleeve. The method may also include locking the compression sleeve in position using a body locking mechanism after activating the compression sleeve. The method may also include shifting the shifting sleeve from the activated position to an unactivated position; and removing the second wellbore tubular from the first tubular. The method may also include positioning the collet protrusion above the locking feature after positioning the locking feature between the collet protrusion and the compression sleeve, and repositioning the locking feature between the collet protrusion and the compression sleeve. The method may also include shifting the shifting sleeve from the activated position to an unactivated position, raising the second wellbore tubular with respect to the first wellbore tubular, repositioning the locking feature between the collet protrusion and the compression sleeve, and shifting the shifting sleeve into an activated position after the repositioning. The second wellbore tubular may not be removed from the second wellbore tubular or the wellbore prior to the repositioning step.

These and other features will be more clearly understood from the following detailed description taken in conjunction with the accompanying drawings and claims.

BRIEF DESCRIPTION OF THE DRAWINGS

For a more complete understanding of the present disclosure and the advantages thereof, reference is now made to the following brief description, taken in connection with the accompanying drawings and detailed description.

DETAILED DESCRIPTION OF THE EMBODIMENTS

Figure 1:
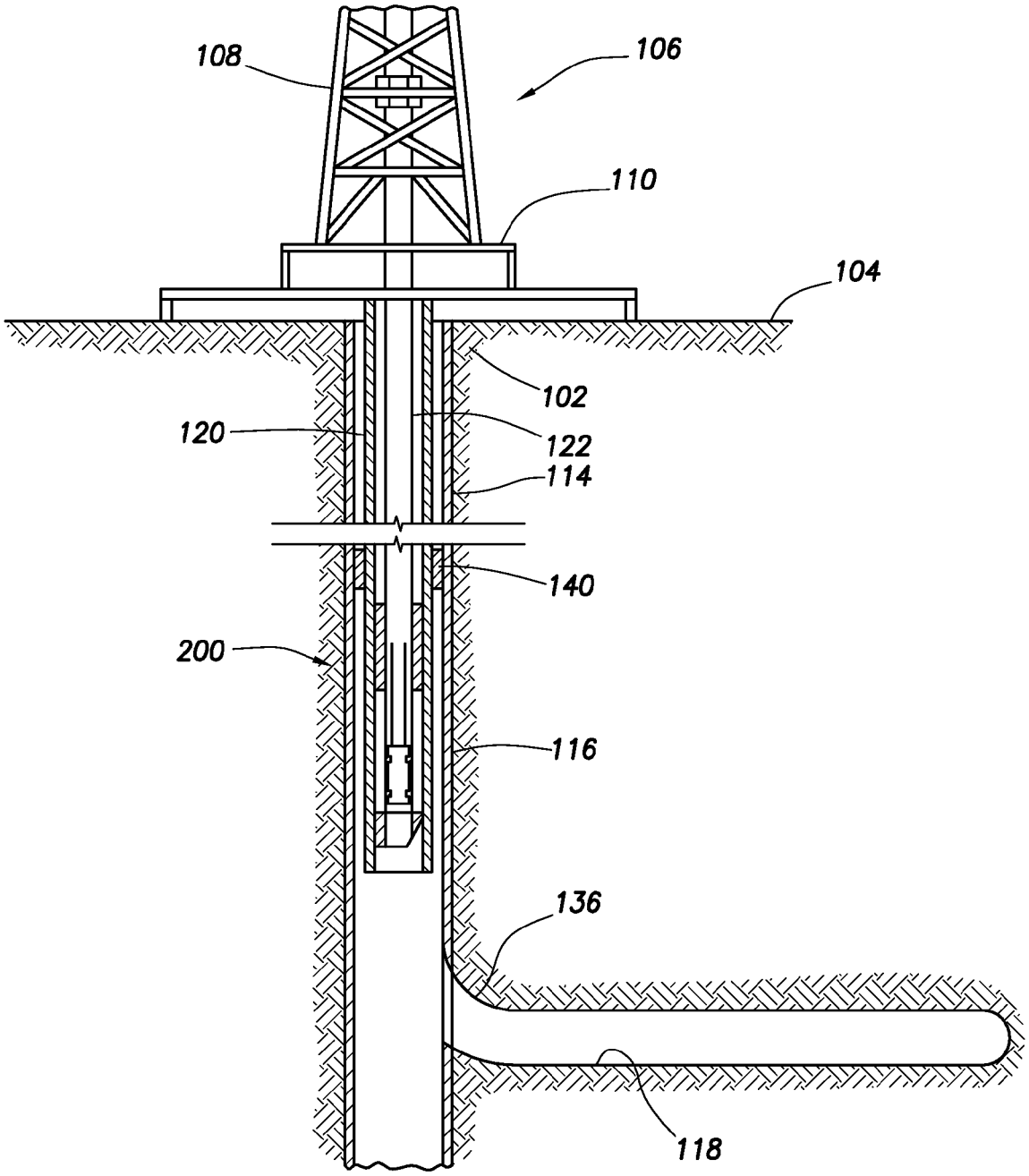
FIG. 1 is a schematic view of an embodiment of a subterranean formation and wellbore operating environment.

In the drawings and description that follow, like parts are typically marked throughout the specification and drawings with the same reference numerals, respectively. The drawing figures are not necessarily to scale. Certain features of the invention may be shown exaggerated in scale or in somewhat schematic form and some details of conventional elements may not be shown in the interest of clarity and conciseness.

Unless otherwise specified, any use of any form of the terms "connect," "engage," "couple," "attach," or any other term describing an interaction between elements is not meant to limit the interaction to direct interaction between the elements and may also include indirect interaction between the elements described. In the following discussion and in the claims, the terms "including" and "comprising" are used in an open-ended fashion, and thus should be interpreted to mean "including, but not limited to . . . ". Reference to up or down will be made for purposes of description with "up," "upper," "upward," "upstream," or "above" meaning toward the surface of the wellbore and with "down," "lower," "downward," "downstream," or "below" meaning toward the terminal end of the well, regardless of the wellbore orientation. The various characteristics mentioned above, as well as other features and characteristics described in more detail below, will be readily apparent to those skilled in the art with the aid of this disclosure upon reading the following detailed description of the embodiments, and by referring to the accompanying drawings.

Disclose herein are devices, systems, and methods for preventing relative axial movement between tubular strings. Referring to FIG. 1, an example of a wellbore operating environment in which an axial locking mechanism 200 may be used is shown. As depicted, the operating environment comprises a workover and/or drilling rig 106 that is positioned on the earth's surface 104 and extends over and around a wellbore 114 that penetrates a subterranean formation 102 for the purpose of recovering hydrocarbons. The wellbore 114 may be drilled into the subterranean formation 102 using any suitable drilling technique. The wellbore 114 extends substantially vertically away from the earth's surface 104 over a vertical wellbore portion 116, deviates from vertical relative to the earth's surface 104 over a deviated wellbore portion 136, and transitions to a horizontal wellbore portion 118. In alternative operating environments, all or portions of a wellbore may be vertical, deviated at any suitable angle, horizontal, and/or curved. The wellbore may be a new wellbore, an existing wellbore, a straight wellbore, an extended reach wellbore, a sidetracked wellbore, a multi-lateral wellbore, and other types of wellbores for drilling and completing one or more production zones. Further the wellbore may be used for both producing wells and injection wells.

An outer wellbore tubular string 120 and an inner wellbore tubular string 122 comprising an axial locking mechanism 200 may be lowered into the subterranean formation 102 for a variety of workover, treatment, and/or production processes throughout the life of the wellbore. The embodiment shown in FIG. 1 illustrates the outer wellbore tubular 120 in the form of a production tubing string comprising an inner wellbore tubular string disposed in the wellbore 114. It should be understood that the outer wellbore tubular 120 and the inner wellbore tubular 122 are equally applicable to any type of wellbore tubulars being inserted into a wellbore as part of a process needing to limit the relative axial movement between the tubular strings, including as non-limiting examples drill pipe, casing, liners, jointed tubing, and coiled tubing. In an embodiment, the outer wellbore tubular string 120 may comprise the wellbore casing, which may be cemented into place in the wellbore. For example, the axial locking mechanism 200 may be used to prevent relative axial movement between a production tubular string and the wellbore casing. In another embodiment, the outer wellbore tubular string 120 may comprise a collar on a downhole tool, and the inner wellbore tubular string 122 may comprise a connection tubing (e.g., coiled tubing, jointed tubing, etc.) for providing fluid to the downhole tool. In this embodiment, the axial locking mechanism 200 may be used as a connection means between the downhole tool and the wellbore tubular string where the outer wellbore tubular string 120 may comprise the downhole tool collar and the inner wellbore tubular string 122 may comprise the wellbore tubular passing through the collar. Further, a means of isolating various zones within a wellbore 114 may take various forms. For example, a zonal isolation device such as a packer (e.g., packer 140), may be used to isolate the various zone within a wellbore 114.

The workover and/or drilling rig 106 may comprise a derrick 108 with a rig floor 110 through which the wellbore tubular 120 extends downward from the drilling rig 106 into the wellbore 114. The workover and/or drilling rig 106 may comprise a motor driven winch and other associated equipment for extending the outer wellbore tubular 120 and/or the inner wellbore tubular 122 into the wellbore 114 to position the outer wellbore tubular 120 and/or inner wellbore tubular 122 at a selected depth. While the operating environment depicted in FIG. 1 refers to a stationary workover and/or drilling rig 106 for conveying the outer wellbore tubular 120 and/or the inner wellbore tubular 122 comprising the axial locking mechanism 200 within a land-based wellbore 114, in alternative embodiments, mobile workover rigs, wellbore servicing units (such as coiled tubing units), and the like may be used to lower the outer wellbore tubular 120 and/or the inner wellbore tubular comprising the axial locking mechanism 200 into the wellbore 114. It should be understood that an outer wellbore tubular 120 and/or inner wellbore tubular 122 may alternatively be used in other operational environments, such as within an offshore wellbore operational environment.

Regardless of the type of operational environment in which the axial locking mechanism 200 is used, it will be appreciated that axial locking mechanism 200 serves to control the relative axial movement between two wellbore tubulars in a coaxial arrangement over at least a portion of their respective lengths. As described in greater detail with reference to FIG. 2, the axial locking mechanism 200 comprises a collet 204 and a shifting sleeve 206 disposed within the collet 204 to prop the collet 204 in an open position. A compression sleeve 208 may be disposed above the collet 204 to act to limit movement due to compression loads on the inner wellbore tubular 122. A locking feature is disposed on the inner surface of the outer wellbore tubular 120 to act as a connection point to which the axial locking mechanism 200 is coupled, allowing the inner wellbore tubular 122 to be constrained in an axial direction (i.e., a longitudinal direction) with respect to the outer wellbore tubular 120. In an embodiment, the locking feature may comprise an upset disposed along the inner surface of the outer wellbore tubular 120. The upset may require a force to be applied to the inner wellbore tubular 122 to move the collet past the upset and may be referred to as a collet indicator 202.

Figure 2:
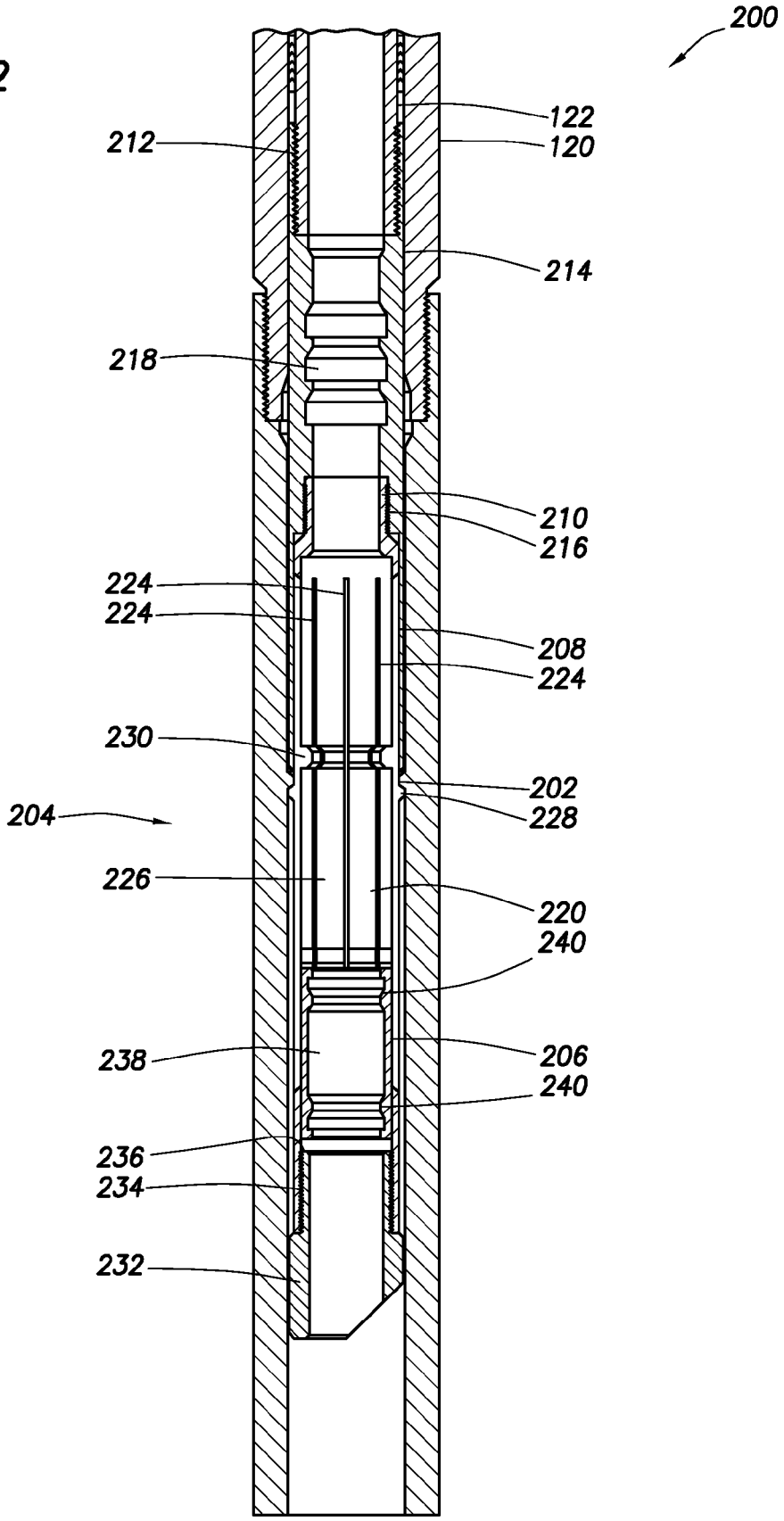
FIG. 2 is a schematic cross sectional view of an embodiment of an axial locking mechanism according to the present disclosure.

The axial locking mechanism 200 is shown in FIG. 2 in the configuration in which it may be conveyed into the wellbore 114. In an embodiment, the axial locking mechanism 200 may be coupled to an inner wellbore tubular 122 by any known connection means. In an embodiment, the axial locking mechanism 200 may be coupled to the inner wellbore tubular 122 by a threaded connection 212 formed between the inner wellbore tubular 122 and an upper mandrel 214. The upper mandrel 214 may comprise a generally tubular mandrel assembly or means. The outer diameter of the upper mandrel 214 may be sized to allow the upper mandrel 214 to be conveyed within the outer wellbore tubular 120. A longitudinal fluid passage 218 extends through the upper mandrel 214 to allow for the passage of fluids and/or tools (e.g., a setting tool) therethrough.

A lower mandrel assembly 210 may be coupled to the upper mandrel 214 and may comprise the collet 204. The lower mandrel assembly 210 may be coupled to the upper mandrel 214 using any known connection means including, a threaded connection, a compression fitting, welding, brazing, or any combination thereof. In an embodiment, the lower mandrel assembly 210 is coupled to the upper mandrel 214 using a threaded connection 216. The lower mandrel assembly 210 may comprise a generally tubular mandrel assembly or means. The outer diameter of the lower mandrel assembly 210 is sized to allow the lower mandrel assembly 210 to be conveyed within the outer wellbore tubular 120. A longitudinal flow passage 220 extends through the lower mandrel assembly 210 to allow for the passage of fluids and/or tools (e.g., a setting tool) therethrough. A guide 232 may be coupled to the lower end of the lower mandrel assembly 210. The guide 232 may help to direct the inner wellbore tubular 122 with the axial locking mechanism 200 through the interior of the outer wellbore tubular 120. In an embodiment, a threaded connection 234 may be used to couple the guide 232 to the lower mandrel assembly 210.

The lower mandrel assembly 210 comprises a collet 204. In general, a collet 204 may generally comprise one or more springs (e.g., beam springs) and/or spring means separated by slots. A collet 204 may generally be configured to allow for a limited amount of radial compression in response to a radially compressive force, and/or a limited amount of radial expansion in response to a radially expansive force. In an embodiment, the collet 204 used with the axial locking mechanism 200 as shown in FIG. 2 may be configured to allow for a limited amount of radial compression in response to a radially compressive force. The radial compression may allow the collet to pass by a restriction in a wellbore and/or tubular while returning to the original diameter once the collet has moved past the restriction. In an embodiment, the collet 204 comprises a collet mandrel 226, which comprises a section of the lower mandrel assembly 210 with one or more longitudinal cuts forming slots 224 along its length. In an embodiment, the slots may comprise angled slots, as measured with respect to the longitudinal axis, helical slots, and/or spiral slots for allowing at least some radial compression in response to a radially compressive force. The collet 204 also comprises a collet protrusion 228 disposed on the outer surface of the collet mandrel 226. The slots 224 allow the collet protrusion 228 to at least partially compress inward (i.e., radially compress) in response to a radially compressive force, as described in more detail below. The collet protrusion 228 generally comprises a section of the collet mandrel 226 with an expanded outer diameter. The collet protrusion 228 may extend around the outer surface of the collet mandrel 226, and the collet protrusion 228 may comprise the one or more slots 224 that align with the slots 224 in the collet mandrel 226 to allow the collet protrusion 228 to radially compress. In an embodiment, the slots 224 may extend through both the collet mandrel 226 and the collet protrusion 228 to provide a continuous slot along the length of the collet 204. The collet protrusion 228 may comprise one or more flat surfaces for contacting the collet indicator 202 disposed on the outer wellbore tubular 120. In an embodiment, the flat surfaces may be disposed at obtuse angles with respect to the angle between the outer surface of the collet mandrel 226 and the flat surface as measured in a longitudinal direction. This angle may allow for a radially compressive force to be applied to the collet mandrel 226 when the collet protrusion 228 contacts the collet indicator 202.

The collet mandrel 226 may comprise a section with a reduced inner diameter, creating an inner collet shoulder 230. The inner collet shoulder 230 may serve as a restriction to the movement of the shifting sleeve 206 disposed within the lower mandrel assembly 210, and in an embodiment, may be disposed out of radial alignment with the collet indicator 228. For example, the inner collet shoulder 230 may be disposed above the collet protrusion when the shifting sleeve 206 is disposed below the inner collet shoulder 230 to allow the shifting sleeve to 206 translate between the lower portion of the collet mandrel 226 and the inner collet shoulder 230. This positioning may allow the shifting sleeve 206 to be positioned in radial alignment with the collet indicator 228, as described in more detail below.

The shifting sleeve 206 may be slidingly engaged within the lower mandrel assembly 210. The shifting sleeve may have an outer diameter configured to allow the shifting sleeve 206 to shift and/or translate in an axial direction within the lower mandrel assembly 210. In an embodiment, the inner collet shoulder 230 and a guide shoulder 236 comprising an upper edge of the guide 232 may serve as restrictions to the movement of the shifting sleeve 206. The shifting sleeve may be generally tubular in shape and may comprise a longitudinal flow passage 238 extending therethrough. One or more reduced inner diameter sections may be disposed along the inner surface of the shifting sleeve 206 to create one or more inner upsets 240. The inner upsets 240 may be used to actuate and or shift the shifting sleeve 206 between an initial and an activated position within the collet mandrel 226.

A locking feature is disposed on the inner surface of the outer wellbore tubular 120. In an embodiment, the locking feature comprises a collet indicator 202. Similar to the collet protrusion 228, the collet indicator 202 may comprise one or more flat surfaces (e.g., an upper flat surface and a lower flat surface) for contacting the collet protrusion 228 disposed on the collet mandrel 226. In an embodiment, the flat surfaces may be disposed at obtuse angles with respect to the angle between the inner surface of the outer wellbore tubular 120 and the flat surface as measured in a longitudinal direction. This angle may allow for a radially compressive force to be applied to the collet protrusion 228 when the collet protrusion 228 contacts the collet indicator 202. In an embodiment, the upper surface of the collet indicator 202 may be approximately parallel and/or configured to uniformly engage (e.g., using matched surfaces) the lower surface of the compression sleeve 208. In an embodiment, the lower surface of the collet indicator 202 may be approximately parallel and/or configured to uniformly engage (e.g., using matched surfaces) the upper surface of the collet protrusion 228. In an embodiment, the upper surface of the collet indicator 202 may be approximately parallel and/or configured to uniformly engage (e.g., using matched surfaces) the lower surface of the collet protrusion 228 to allow the collet protrusion 228 to engage and pass over the collet indicator 202.

A compression sleeve 208 may be coupled to the upper mandrel 214 and/or the lower mandrel assembly 210 and extend around a portion of the lower mandrel assembly 210. The compression sleeve 208 may comprise any means or structures capable of resisting a compressive load applied to the inner wellbore tubular 122. As used herein, a compressive load refers to a load in a downward direction that acts to compress a wellbore tubular. As used herein, a tensile load refers to a load in an upward direction that act to place a wellbore tubular in tension. In an embodiment, the compression sleeve 208 comprises a generally tubular section with an outer diameter that is approximately the same as the outer diameter of the collet protrusion 228 disposed on the collet mandrel 226 and is configured to pass through the inner diameter of the outer wellbore tubular 120. The outer diameter of the compression sleeve 208 is configured to be greater than the inner diameter of the collet indicator 202 so that upon contact between the lower edge of the compression sleeve 208 and the upper surface of the collet indicator 202, the inner wellbore tubular 122 is prevented from further movement in a downward direction. In an embodiment the compression sleeve 208 is configured to support a load equal to or greater than the compressive load imposed by and/or on the inner wellbore tubular 122 so that the inner wellbore tubular 122 is supported by the interaction of the compression sleeve 208 and the collet indicator 202.

The axial locking mechanism 200 acts to prevent relative axial motion between the outer wellbore tubular 120 and the inner wellbore tubular 122 by resisting movement at a single locking feature. In an embodiment, the combination of the compression sleeve 208 and the collet protrusion 228 are used to couple the inner wellbore tubular to the outer wellbore tubular at the locking feature with respect to both compressive and tensile loads. The compression sleeve 208 resists compression loads on the inner wellbore tubular 122 due to the interaction of the lower edge of the compression sleeve 208 with the collet indicator 202, and the collet protrusion 228 resists tension loads on the inner wellbore tubular 122 when placed in a locked position due to the interaction of the upper edge of the collet protrusion 228 with the collet indicator 202.

The amount of movement about the locking feature may depend on the longitudinal length of the locking feature and the distance between the lower surface of the compression sleeve 208 and the upper surface of the collet protrusion 228. The length of the compression sleeve 208 may vary but may generally extend to a distance near the collet protrusion 228. In an embodiment, the distance between the lower surface of the compression sleeve 208 and the upper surface of the collet protrusion 228 may be about 2 inches, about 1 inch, about 0.5 inches, about 0.25 inches, about 0.125 inches, or alternatively about 0.0625 inches greater than the width of the collet indicator 202. The distance may allow for a limited amount of movement between the inner wellbore tubular 122 and the outer wellbore tubular 120. The distance may also allow for some tolerance in engaging the axial locking mechanism 200 to the collet indicator 202 in the event that some contaminates or solid particles are present during the coupling process.

Figure 3:
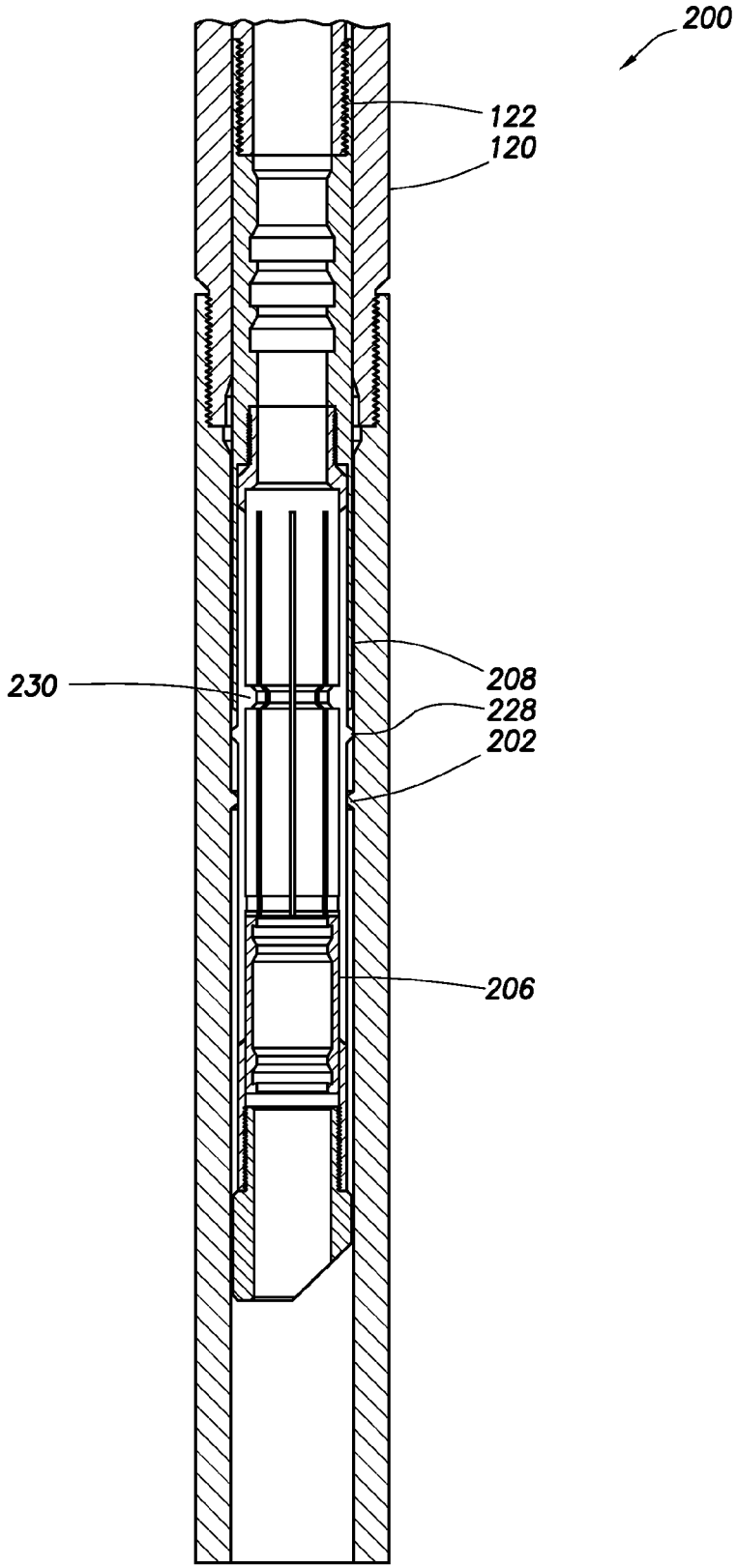
FIG. 3 is another schematic cross sectional view of an embodiment of an axial locking mechanism according to the present disclosure.
Figure 4:
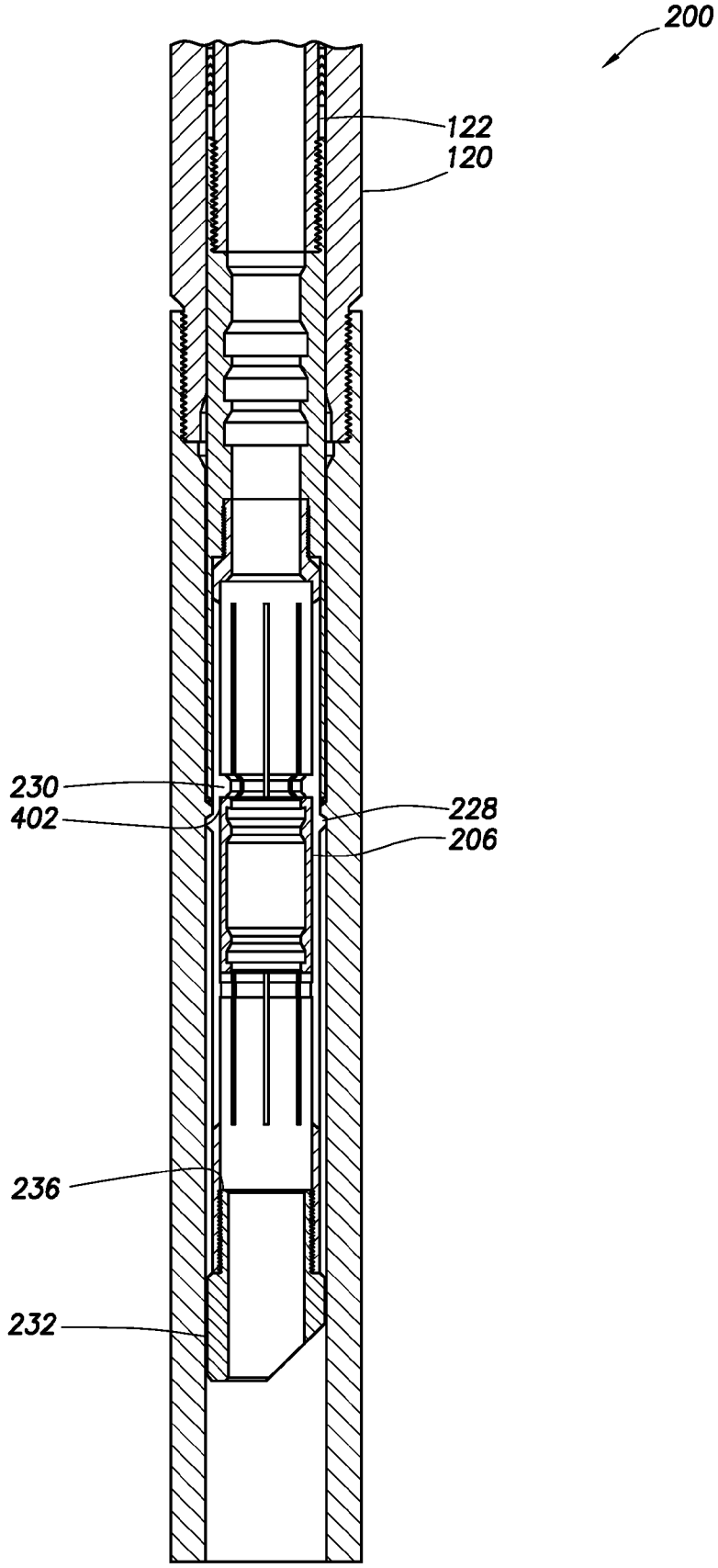
FIG. 4 is yet another schematic cross sectional view of an embodiment of an axial locking mechanism according to the present disclosure.

The axial locking mechanism may be installed and activated as shown in FIG. 2 through FIG. 4. FIG. 3 illustrates the configuration of the axial locking mechanism 200 as it is conveyed within the wellbore on the inner wellbore tubular 122. The axial locking mechanism 200 may first be positioned within the outer wellbore tubular 120. Upon contacting the collet indicator 202, the collet protrusion 228 may radially compress and pass over the collet indicator 202.

The axial locking mechanism 200 may now be positioned as shown in FIG. 2. Once the collet protrusion 228 has passed over the collet indicator 202, the lower surface of the compression sleeve 208 may engage the collet indicator 202 and support a compressive load on the inner wellbore tubular 122. This process may optionally be repeated as needed to allow for proper spacing of the outer wellbore tubular 120 and/or the inner wellbore tubular 122 with respect to each other, the wellbore, and/or surface equipment.

The axial locking mechanism may be activated once the collet indicator 202 is located between the collet protrusion 228 and the compression sleeve 208. A downhole tool configured to shift the shifting sleeve 206 may be conveyed within the wellbore to engage the shifting sleeve and place the shifting sleeve 206 in an activated position. In an embodiment, a suitable downhole tool may be configured to engage one or more inner upsets 240 disposed on the shifting sleeve 206. In an embodiment, a suitable downhole tool for shifting the shifting sleeve 206 may be conveyed within the wellbore using a wireline, slick line, and/or coiled tubing. In an embodiment, the shifting sleeve 206 may be shifted upwards until the upper edge 402 of the shifting sleeve 206 engages the inner collet shoulder 230. Once the shifting sleeve 206 has been shifted by the downhole tool, the downhole tool may be retrieved to the surface of the wellbore.

Upon shifting the shifting sleeve 206 into an activated position, the axial locking mechanism 200 may be configured as shown in FIG. 4. This configuration may represent the activated configuration of the axial locking mechanism 200. When the shifting sleeve 206 is positioned in radial alignment with the collet protrusion 228, the collet protrusion 228 may be prevented from radially compressing, which may allow the inner wellbore tubular 122 to resist movement due to tensile loading. When activated, the axial locking mechanism 200 may allow an inner wellbore tubular 122 to resist loads in both compression and tension with respect to the outer wellbore tubular 120. Further, the resistance to relative motion occurs at a single location in the wellbore, which may limit the total amount of movement of the inner wellbore tubular 122 with respect to the outer wellbore tubular 120. As a result, the ability to restrict relative axial movement between two wellbore tubulars at a single locking feature represents an advantage of the present systems and methods.

In order to deactivate the axial locking mechanism 200, the activation process may be repeated in the reverse order. Specifically, a suitable downhole tool may be conveyed within the wellbore and engage the shifting sleeve 206, which may be positioned as shown in FIG. 4. In an embodiment, the shifting sleeve 206 may be shifted downwards until the lower edge of the shifting sleeve 206 engages the guide shoulder 230 located on the upper edge of the guide 232. Once the shifting sleeve 206 has been shifted by the downhole tool, the downhole tool may be retrieved to the surface of the wellbore.

The axial locking mechanism may now be configured as shown in FIG. 2. Since the shifting sleeve 206 is not radially aligned with the collet protrusion 228, the collet protrusion may be radially compressed upon loading the inner wellbore tubular 122 in tension. The radial compression may then result in the collet protrusion 228 passing over the collet indicator 202 and allowing the inner wellbore tubular 122 with the axial locking mechanism 200 to be conveyed uphole and/or removed from the wellbore. In an embodiment, the inner wellbore tubular 122 and the axial locking mechanism 200 may be conveyed within the outer wellbore tubular 120 and/or the wellbore without being removed from the wellbore. The axial locking mechanism may be repositioned with respect to the outer wellbore tubular and the locking feature and reactivated without being removed from the outer wellbore tubular and/or the wellbore. This process may be repeated a plurality of times during the use of the axial locking mechanism. This process may be used to adjust the spacing of the wellbore tubulars and/or replacement of various components of the wellbore without the need to remove the entire inner wellbore tubular 122 or any portion thereof from the wellbore to reset the axial locking mechanism.

Figure 5A:
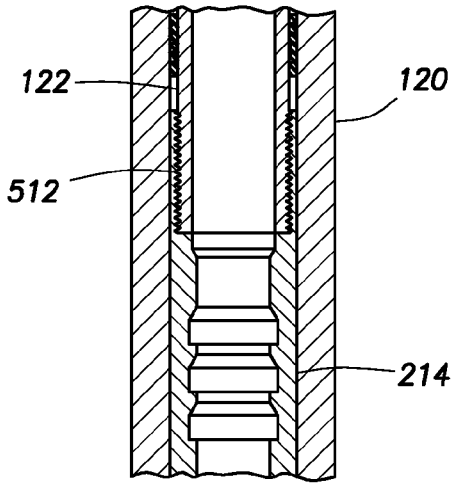
FIG. 5A and FIG. 5B are serial schematic cross sectional views of an embodiment of an axial locking mechanism according to the present disclosure.
Figure 5B:
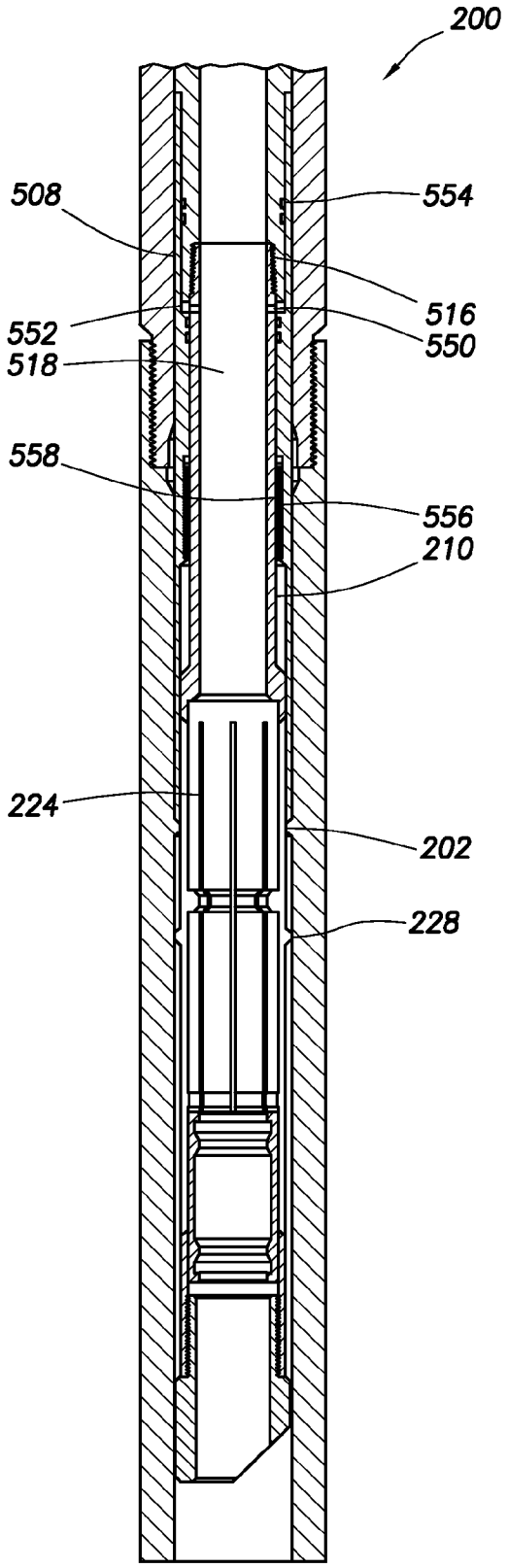

In an embodiment as shown in FIG. 5B, the compression sleeve 508 may be slidingly engaged with the upper mandrel 214 and/or the lower mandrel assembly 210. In this embodiment, the compression sleeve 508 may be activated to engage the collet indicator 202, thereby presenting a compression force about the collet indicator 202 between the lower surface of the compression sleeve 208 and the collet protrusion 228 disposed on either side of the collet indicator 202. This embodiment may allow for the axial locking mechanism 200 to be activated in a manner that limits the relative movement between the inner wellbore tubular 122 and the outer wellbore tubular 120 about the locking feature (e.g., the collet indicator 202).

In an embodiment, the compression sleeve 508 may be configured as shown in FIG. 5A and FIG. 5B, which are serial views of the axial locking mechanism 200 disposed on the inner wellbore tubular 122 within the outer wellbore tubular 120. In an embodiment, the upper mandrel 214 may be coupled to the inner wellbore tubular 122 using a connection means (e.g., threaded connection 512). The lower mandrel assembly 210 may be coupled to the upper mandrel 214 using a connection means (e.g., threaded connection 516). The compression sleeve 508 may be slidingly engaged about the upper mandrel 214 and/or the lower mandrel assembly 210.

In an embodiment, the compression sleeve 508 may be configured for hydraulic activation. One or more ports 550 may be disposed in the upper mandrel 214 and/or the lower mandrel assembly 210 to allow for fluid communication between the longitudinal flow passage 518 and a hydraulic chamber 552 formed between a surface of the compression sleeve 508 and a surface of the upper mandrel 214 and/or the lower mandrel assembly 210. The compression sleeve 508 may have a shoulder that forms the lower portion of the hydraulic chamber 552, thereby forming a hydraulic piston, that upon activation, causes the compression sleeve 508 to shift downward with respect to the upper mandrel 214 and/or the lower mandrel assembly 210, as described in more detail below. One or more seals 554 may be disposed between the compression sleeve 508 and the upper mandrel 214 and/or the lower mandrel assembly 210 to prevent fluid leakage when pressure is applied to the hydraulic chamber 552. The seals may include, but are not limited to, polymeric and/or elastomeric materials.

In an embodiment, the compression sleeve 508 may be configured to maintain an activated position. As shown in FIG. 5B, a body locking mechanism may be disposed between the compression sleeve 508 and the lower mandrel assembly 210 to allow movement of the compression sleeve 508 in one direction while restricting movement of the compression sleeve 508 in the opposite direction. For example, the body locking mechanism may allow the compression sleeve to move downward to engage the collet indicator 202 while restricting any upwards movement of the compression sleeve 508.

In an embodiment, the body locking mechanism may comprise a series of ratchet teeth 556 disposed on an inner surface of the compression sleeve that engage a series of corresponding ratchet teeth 558 disposed on an outer surface of the lower mandrel assembly 210. The ratchet teeth 558 may be disposed along a length of the lower mandrel assembly 210 through which the compression sleeve 508 may translate during activation. The ratchet teeth 556 on the compression sleeve 508 may be integrally formed on an inner surface, or they may be disposed on a separate assembly that is connected to the compression sleeve 508. For example, a ratchet teeth liner may be coupled to the inner surface of the compression sleeve 508 using, for example, a threaded connection.

In order to activate the hydraulic mechanism, one or more sealing devices may be used within the longitudinal flow passage through the upper mandrel 214 and/or the lower mandrel assembly 210 to allow pressure to be applied to the hydraulic chamber 552 through the ports 550. In an embodiment, the downhole tool used to activate the axial locking mechanism may be used as the sealing device. For example, the downhole tool may comprise one or more sealing elements that may engage the inner surface of the axial locking mechanism 200 and allow for the pressurization of the flow passage 518. The sealing elements may be configured to engage the inner surface of the axial locking mechanism based on a number of inputs such as tension impulses provided by slick line, wireline, and/or coiled tubing. Alternatively, the sealing elements may be activated based on an internal pressurization mechanism (e.g., an internal hydraulic cylinder) within the downhole tool, where the pressure may be supplied by a fluid within coiled tubing used to convey the downhole tool to the axial locking mechanism. Alternatively, the sealing device may be activated based on a rotation of the downhole tool.

In an embodiment, the downhole tool may comprise one or more additional elements for forming at least a partial seal between the downhole tool and the inner surface of the axial locking mechanism 200. For example, one or more ports may be disposed in the downhole tool that may be closed through the use of a valve. In an embodiment, the ports may be closed through the use of one or more elastomeric balls and/or darts. The elastomeric balls and/or darts may generally comprise an elastomeric and/or polymeric material configured to sealingly engage a port and maintain the seal when pressure is applied in one direction (e.g., pressure applied from above). Upon releasing the pressure or reversing the fluid flow through the port, the elastomeric balls and/or darts may be released for retrieval and/or disposal.

In an embodiment, the axial locking mechanism 200 may comprise a sealing device to allow for the activation of the compression sleeve without the need for an additional downhole tool. An internal shoulder and/or seal seat may be disposed above the slots 224 in the upper mandrel 214 and/or the lower mandrel assembly 210. The internal shoulder and/or seal seat may be disposed above the slots 224 to reduce any fluid leakage through the slots 224. In an embodiment, one or more elastomeric balls and/or darts may be used to form at least a partial seal at the internal shoulder and/or sealing seat. Upon the introduction of the elastomeric balls and/or darts, pressure may be applied to the flow passage 518 to allow the hydraulic chamber 552 to be pressurized, thereby activating the compression sleeve 508.

The axial locking mechanism 200 with a shifting compression sleeve 508 may be installed and activated as shown in FIG. 5A through FIG. 8. FIG. 5A and FIG. 5B illustrates the configuration of the axial locking mechanism 200 as it is conveyed within the wellbore on the inner wellbore tubular 122. The axial locking mechanism 200 may first be positioned within the outer wellbore tubular 120. Upon contacting the collet indicator 202, the collet protrusion 228 may radially compress and pass over the collet indicator 202.

Once the collet protrusion 228 has passed over the collet indicator 202, the lower surface of the compression sleeve 508, which may be in a run-in configuration, may engage the collet indicator 202 and support a compressive load on the inner wellbore tubular 122. This process may optionally be repeated as needed to allow for proper spacing of the outer wellbore tubular 120 and/or the inner wellbore tubular 122 with respect to each other, the wellbore, and/or surface equipment.

Figure 6:
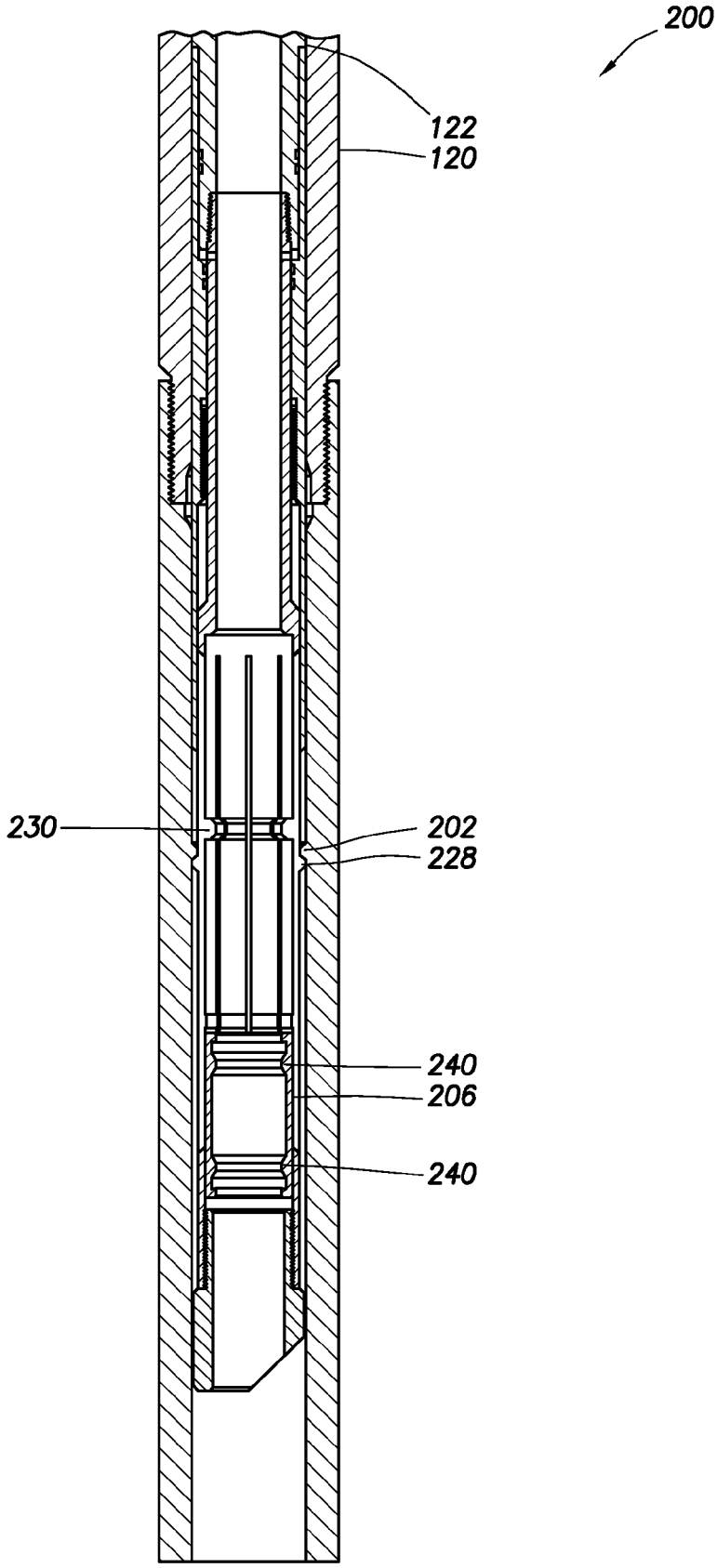
FIG. 6 is a schematic cross sectional view of an embodiment of an axial locking mechanism according to the present disclosure.

As shown in FIG. 6, the inner wellbore tubular 122 may then be positioned to allow the collet protrusion 228 to engage the collet indicator 202. The axial locking mechanism 200 may then be activated. A downhole tool configured to shift the shifting sleeve 206 may be conveyed within the inner wellbore tubular 122 to engage the shifting sleeve 206 and place the shifting sleeve 206 in an activated position. In an embodiment, a suitable downhole tool may be configured to engage one or more inner upsets 240 disposed on the shifting sleeve 206. The shifting sleeve 206 may be shifted upwards until the upper edge of the shifting sleeve 206 engages the inner collet shoulder 230.

Figure 7:
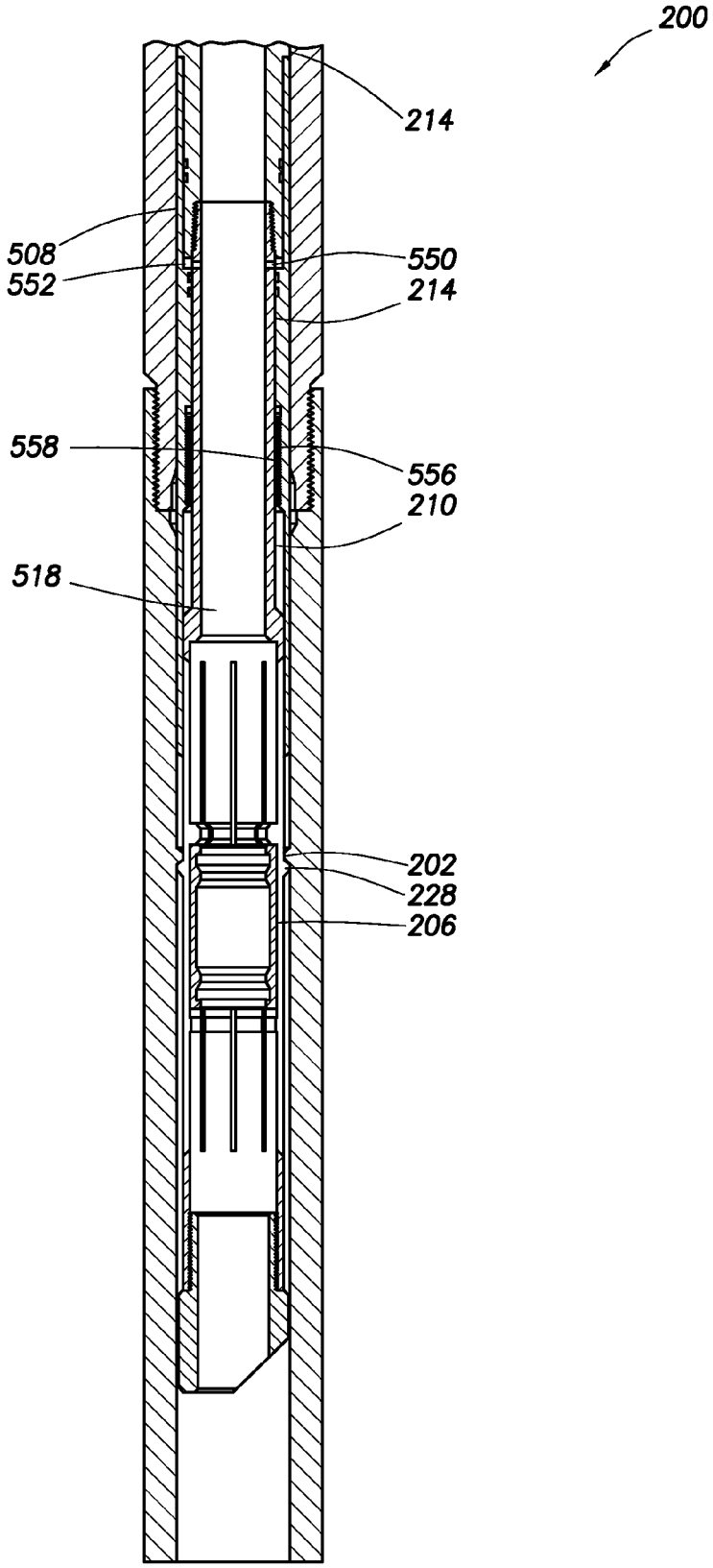
FIG. 7 is another schematic cross sectional view of an embodiment of an axial locking mechanism according to the present disclosure.

Upon shifting the shifting sleeve 206 into an activated position, the axial locking mechanism 200 may be configured as shown in FIG. 7. A tensile load may then be placed on the inner wellbore tubular 122 to maintain the engagement between the collet protrusion 228 and the collet indicator 202. The compression sleeve 508 may then be activated. In an embodiment, the downhole tool used to shift the shifting sleeve 206 may be used to seal the longitudinal flow passage 518 through the lower mandrel assembly 210. Alternatively, one or more of the sealing devices as discussed above (e.g., seal seats with sealing balls and/or darts) may be used to seal the longitudinal flow passage 518 through the lower mandrel assembly 210. Upon forming at least a partial seal, the pressure may be increased within the inner wellbore tubular 122. The resulting pressure may be transmitted through the ports 550 into the hydraulic chamber 552. The resulting pressure increase in the hydraulic chamber 552 may act on the piston area (e.g., the compression sleeve 508 shoulder area) of the compression sleeve 508 to shift the compression sleeve 508 downward with respect to the upper mandrel 214 and the lower mandrel assembly 210.

As the compression sleeve 508 shifts downwards, the body locking mechanism may maintain the compression sleeve 508 in the shifted position. In an embodiment as shown in FIG. 7, the ratchet teeth 556 disposed on the compression sleeve 508 may engage the corresponding ratchet teeth 558 disposed on the lower mandrel assembly 210 to allow movement in a downward direction while restricting movement in the opposite direction. The compression sleeve 508 may continue to shift in a downward direction in response to the pressure increase until the lower surface of the compression sleeve 508 engages the collet indicator 202.

Figure 8:
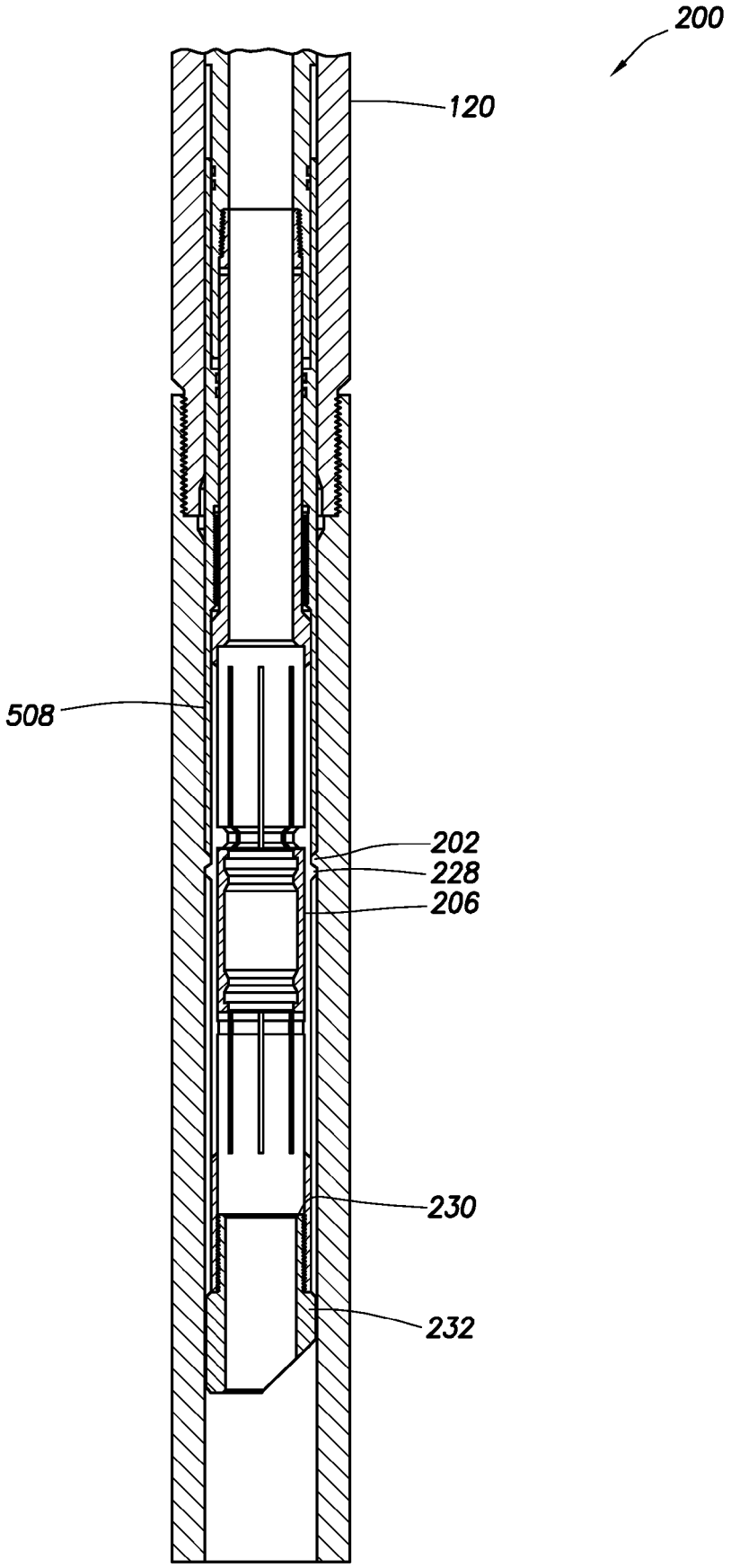
FIG. 8 is yet another schematic cross sectional view of an embodiment of an axial locking mechanism according to the present disclosure.

The resulting activated axial locking mechanism 200 may be configured as shown in FIG. 8. In this configuration, both the compression sleeve 508 and the collet protrusion 228 are engaged with the collet indicator 202, thereby resisting relative motion between the inner wellbore tubular 122 and the outer wellbore tubular 120 about a single location. The compression 508 sleeve may engage the collet indicator 202 with a force determined by the geometry of the hydraulic activation mechanism (e.g., the piston area) and the pressure within the inner wellbore tubular 122. As a result of the hydraulic activation mechanism, the axial locking mechanism 200 can be activated to provide a clamping force about the collet indicator 202. The resulting clamping force may further be maintained through the use of the body locking mechanism. This process may result in an activated state of the axial locking mechanism with a limited amount of relative axial movement between the two wellbore tubulars. For example, the movement about the collet indicator 202 may be limited to the distance between the adjacent ratchet teeth on the body locking mechanism. The ability to restrict relative axial movement between two wellbore tubulars at a single locking feature and provide a clamping force about the single locking feature represents an advantage of the present systems and methods.

In order to deactivate the axial locking mechanism 200 as shown in FIG. 8, the shifting sleeve 206 may be shifted out of alignment with the collet protrusion 228 to allow for radial compression of the collet protrusion 228. Specifically, a suitable downhole tool may be conveyed within the wellbore and engage the shifting sleeve 206, which may be positioned as shown in FIG. 8. In an embodiment, the shifting sleeve 206 may be shifted downwards until the lower edge of the shifting sleeve 206 engages the guide shoulder 230 located on the upper edge of the guide 232. Since the shifting sleeve 206 is not radially aligned with the collet protrusion 228 once the shifting sleeve 206 is shifted, the collet protrusion 228 may be radially compressed upon loading the inner wellbore tubular 122 in tension. The radial compression may then result in the collet protrusion passing 228 over the collet indicator 202 and allowing the inner wellbore tubular 122 to be conveyed uphole and/or removed from the wellbore. In an embodiment, the inner wellbore tubular 122 and the axial locking mechanism 200 may be conveyed within the outer wellbore tubular 120 and/or the wellbore without being removed from the wellbore. The axial locking mechanism may be repositioned with respect to the outer wellbore tubular and the locking feature and reactivated without being removed from the outer wellbore tubular and/or the wellbore. This process may be repeated a plurality of times during the use of the axial locking mechanism. This process may be used to adjust the spacing of the wellbore tubulars and/or replacement of various components of the wellbore without the need to remove the entire inner wellbore tubular 122 or any portion thereof from the wellbore to reset the axial locking mechanism. In an embodiment, the compression sleeve 508 may remain in the activated and locked position, and the axial locking mechanism may be deactivated and reactivated with the compression sleeve in this configuration depending on the amount of clamping force generated during the activation process. During this process, the compression sleeve may be maintained in the shifted position and may be reset to the initial position upon retrieval to the surface of the wellbore.

The axial locking mechanism described herein may be used to restrict the relative axial movement of two wellbore tubulars within a wellbore. The axial locking mechanism 200 provides the ability to restrict the relative axial movement of two wellbore tubulars at a single locking feature, which limits the relative axial movement of the two wellbore tubulars with respect to one another. Further, the use of a compression sleeve with an activation mechanism may allow for a clamping force to be exerted at the locking feature, further limiting the movement of the wellbore tubulars with respect to one another. In addition, the mechanisms, systems, and methods disclosed herein allow for the axial locking mechanism to function without the application of a rotational motion to the inner wellbore tubular, the outer wellbore tubular, and/or any downhole tools. In addition, the axial locking mechanism disclosed herein may be activated, deactivated, and reactivated any number of times without the need to remove the axial locking mechanism from the wellbore to be reset, representing an advantage of the present mechanisms, systems, and methods.

In the foregoing discussion, the shifting sleeve 206 has been described as being radially aligned with the collet protrusion 228 in order to reduce and/or prevent the collet protrusion 228 from radially compressing in response to a tensile load on the inner wellbore tubular 122. In an embodiment, the shifting sleeve 206 may not be radially aligned with the collet protrusion 228. Rather, the shifting sleeve may be radially aligned with a sufficient portion of the slots 224 in the collet mandrel 226 to prevent the radial compression of the collet protrusion 228. Any alignment of the shifting sleeve 206 with respect to the collet mandrel 226 and/or the slots 224 that prevents the collet protrusion 228 from radially compressing may be referred to herein as a propped position of the collet 204.

Further, while the foregoing discussion has described the shifting sleeve 206 as being located at the lower end of the collet mandrel 226, the shifting sleeve can also be located at the upper end of the collet mandrel 226. In an embodiment, the collet mandrel 226 can be configured with the shifting sleeve 206 disposed within the collet mandrel 226 at the upper end, while allowing the collet protrusion 228 adequate spacing to radially compress and pass over the collet indicator 202. Accordingly, it is expressly contemplated that the shifting sleeve 206 may be located at a position other than the lower end of the collet mandrel 226 without varying from the scope of the present mechanisms, systems, and method. While the foregoing discussion has described the axial locking mechanism as being coupled to the inner wellbore tubular and the locking feature as being disposed on the outer wellbore tubular, it is also contemplated that the axial locking mechanism could be coupled to the outer wellbore tubular and the locking feature could be disposed on the inner wellbore tubular without departing from the scope of the present disclosure.

At least one embodiment is disclosed and variations, combinations, and/or modifications of the embodiment(s) and/or features of the embodiment(s) made by a person having ordinary skill in the art are within the scope of the disclosure. Alternative embodiments that result from combining, integrating, and/or omitting features of the embodiment(s) are also within the scope of the disclosure. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, $R_l$, and an upper limit, $R_u$, is disclosed, any number falling within the range is specifically disclosed. In particular, the following numbers within the range are specifically disclosed: $R=R_l+k*(R_u-R_l)$, wherein k is a variable ranging from 1 percent to 100 percent with a 1 percent increment, i.e., k is 1 percent, 2 percent, 3 percent, 4 percent, 5 percent, . . . , 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. Use of the term "optionally" with respect to any element of a claim means that the element is required, or alternatively, the element is not required, both alternatives being within the scope of the claim. Use of broader terms such as comprises, includes, and having should be understood to provide support for narrower terms such as consisting of, consisting essentially of, and comprised substantially of. Accordingly, the scope of protection is not limited by the description set out above but is defined by the claims that follow, that scope including all equivalents of the subject matter of the claims. Each and every claim is incorporated as further disclosure into the specification and the claims are embodiment(s) of the present invention.

What is claimed is:

1. A tubular locking system comprising:

a first wellbore tubular;

an internal locking feature disposed on an inner surface of the first wellbore tubular;

a second wellbore tubular, wherein at least a portion of the second wellbore tubular is disposed within the first wellbore tubular;

a compression sleeve coupled to the second wellbore tubular;

a piston that comprises a hydraulic chamber formed by a surface of the compression sleeve and a portion of the second wellbore tubular;

a port configured to provide fluid communication between a flow passage through the second wellbore tubular and the hydraulic chamber;

a collet coupled to the second wellbore tubular below the compression sleeve; and a shifting sleeve disposed within the collet.

2. The tubular locking system of claim 1, wherein the first wellbore tubular comprises drill pipe, casing, a liner, jointed tubing, coiled tubing, or a collar on a downhole tool.

3. The tubular locking system of claim 1, wherein the second wellbore tubular comprises drill pipe, a liner, jointed tubing, or coiled tubing.

4. The tubular locking system of claim 1, wherein the collet comprises:

a collet mandrel comprising a plurality of longitudinal slots; and a collet protrusion disposed on the outside surface of the collet mandrel.

5. The tubular locking system of claim 4, wherein the first wellbore tubular has a relative axial motion with respect to the second wellbore tubular of less than 2 inches when the shifting sleeve is radially aligned with the collet protrusion.

6. The tubular locking system of claim 1, further comprising: a longitudinal flow passage extending from the second wellbore tubular through the compression sleeve, the collet, and the shifting sleeve.

7. The tubular locking system of claim 1, further comprising a guide coupled to the lower end of the second wellbore tubular below the collet.

8. The tubular locking system of claim 7, wherein the guide comprises a guide shoulder that restricts the downward movement of the shifting sleeve within the collet.

9. The tubular locking system of claim 1, wherein the locking feature comprises a collet indicator comprising one or more flat surfaces.

10. The tubular locking system of claim 9, wherein the one or more flat surfaces are disposed at obtuse angles as measured in an longitudinal direction between the one or more flat surface as and an inner surface of the first wellbore tubular.

11. The tubular locking system of claim 1, further comprising a collet shoulder disposed on an inner surface of the collet, wherein the collet shoulder is configured to restrict the upper movement of the shifting sleeve within the collet.

12. The tubular locking system of claim 1, further comprising a sealing device disposed within the second wellbore tubular above the collet.

13. A tubular locking system comprising:

a first wellbore tubular;

an internal locking feature disposed on an inner surface of the first wellbore tubular;

a second wellbore tubular, wherein at least a portion of the second wellbore tubular is disposed within the first wellbore tubular;

a compression sleeve slidingly engaged with the second wellbore tubular;

a collet coupled to the second wellbore tubular below the compression sleeve;

a sealing device disposed within the second wellbore tubular above the collet; and a shifting sleeve disposed within the collet.

14. The tubular locking system of claim 13, further comprising:

a piston that comprises a hydraulic chamber formed by an surface of the compression sleeve and a portion of the second wellbore tubular, and a port configured to provide fluid communication between a flow passage through the second wellbore tubular and the hydraulic chamber.

15. The tubular locking system of claim 13, further comprising a body locking mechanism.

16. The tubular locking system of claim 15, wherein the body locking mechanism comprises ratchet teeth disposed on an inner surface of the compression sleeve that engage ratchet teeth disposed on an outer surface of the collet.

17. The tubular locking system of claim 13, further comprising a downhole sealing tool disposed within the second wellbore tubular that is configured to form a seal within the second wellbore tubular above the collet.

18. A method comprising:

disposing a first wellbore tubular in a wellbore, wherein the first wellbore tubular comprises a locking feature disposed on an inner surface of the first wellbore tubular;

providing a second wellbore tubular within the first wellbore tubular, wherein the second wellbore tubular comprises an axial locking mechanism coupled thereto, and wherein the axial locking mechanism comprises:

a compression sleeve coupled to the second wellbore tubular;

a collet coupled to the second wellbore tubular below the compression sleeve, wherein the collet comprises a collet mandrel comprising a plurality of longitudinal slots; and a collet protrusion disposed on the outside surface of the collet mandrel; and a shifting sleeve disposed within the collet;

wherein the compression sleeve is slidingly coupled to the second wellbore tubular, and wherein the axial locking mechanism further comprises:

a piston that comprises a hydraulic chamber formed by an surface of the compression sleeve and a portion of the second tubular, and a port configured to provide fluid communication between a flow passage through the second wellbore tubular and the hydraulic chamber;

positioning the locking feature between the collet protrusion and the compression sleeve; and shifting the shifting sleeve into an activated position.

19. The method of claim 18, wherein shifting the shifting sleeve comprises using a downhole tool to engage the shifting sleeve and shift the shifting sleeve within the second tubular.

20. The method of claim 18, wherein shifting the shifting sleeve comprises using slick line, wireline, or coiled tubing.

21. The method of claim 18, wherein shifting the shifting sleeve comprises moving the shifting sleeve to engage an inner collet shoulder disposed within the collet mandrel.

22. The method of claim 18, wherein shifting the shifting sleeve comprises radially aligning the shifting sleeve with the collet protrusion.

23. The method of claim 18, further comprising:

forming at least a partial seal within the second wellbore tubular above the collet;

pressurizing a longitudinal flow passage within the second wellbore tubular;

pressurizing the hydraulic chamber through the port; and activating the compression sleeve.

24. The method of claim 23, wherein activating the compression sleeve comprises engaging the compression sleeve with a first side of the locking feature, engaging the collet protrusion with a second side of the locking feature.

25. The method of claim 18, further comprising:

locking the compression sleeve in position using a body locking mechanism after activating the compression sleeve.

26. The method of claim 18, further comprising:

shifting the shifting sleeve from the activated position to an unactivated position; and removing the second wellbore tubular from the first tubular.

27. The method of claim 18, further comprising:

positioning the collet protrusion above the locking feature after positioning the locking feature between the collet protrusion and the compression sleeve; and repositioning the locking feature between the collet protrusion and the compression sleeve.

28. The method of claim 18, further comprising:

shifting the shifting sleeve from the activated position to an unactivated position;

raising the second wellbore tubular with respect to the first wellbore tubular;

repositioning the locking feature between the collet protrusion and the compression sleeve; and shifting the shifting sleeve into an activated position after the repositioning.

29. The method of claim 28, wherein the second wellbore tubular is not removed from the first wellbore tubular or the wellbore prior to the repositioning step.

* * * * *